United States Patent [19]

Nishiyama et al.

[11] Patent Number: 4,595,457

[45] Date of Patent: Jun. 17, 1986

[54] OIL-IMPREGNATABLE INSULATING BOARD

[75] Inventors: Ryota Nishiyama; Masahiro Amano; Shunji Seino, all of Tokyo; Yutaka Gamou; Hidenori Kawakami, both of Amagasaki, all of Japan

[73] Assignees: Mitsubishi Paper Mills, Ltd.; Mitsubishi Electric Corp., both of Tokyo, Japan

[21] Appl. No.: 257,623

[22] Filed: Apr. 27, 1981

Related U.S. Application Data

[63] Continuation of Ser. No. 895,014, Apr. 10, 1978, abandoned.

[30] Foreign Application Priority Data

Sep. 8, 1977 [JP] Japan ..... 52-108113

[51] Int. Cl.[4] ..... D21H 1/02

[52] U.S. Cl. ..... 162/123; 162/132; 162/133; 162/138; 162/146

[58] Field of Search ..... 162/138, 145, 146, 123, 162/132, 133, 157 R

[56] References Cited

U.S. PATENT DOCUMENTS

| | | | |
|---|---|---|---|
| 3,915,791 | 10/1975 | Langdon | 162/132 |
| 4,060,451 | 11/1977 | Uchiyama et al. | 162/138 |
| 4,091,058 | 5/1978 | Sander et al. | 162/157 R |
| 4,096,313 | 6/1978 | Fujita et al. | 162/138 |

FOREIGN PATENT DOCUMENTS

| | | | |
|---|---|---|---|
| 50-50304 | 5/1975 | Japan | 162/157 R |
| 52-27806 | 3/1977 | Japan | 162/146 |
| 0572962 | 10/1945 | United Kingdom | 162/146 |

*Primary Examiner*—Peter Chin

*Attorney, Agent, or Firm*—Cushman, Darby & Cushman

[57] ABSTRACT

An aqueous slurry comprising fibrous particles of a heat-resistant aromatic polymer and short fibers made of said polymer or insulating inorganic short fibers, or a mixture thereof, is made into a wet web and, after adjusting the water content to 50 to 95 weight %, said wet web is laid up in a desired number of layers, and then the laminate is dewatered and dried for integration under pressure at a temperature not exceeding the softening point of said aromatic polymer, thereby obtaining an oil-impregnatable insulating board with high strength and capable of uniform impregnation of oil therein.

7 Claims, No Drawings

OIL-IMPREGNATABLE INSULATING BOARD

This is a continuation of application Ser. No. 895,014 filed Apr. 10, 1978, abandoned.

This invention relates generally to an oil-impregnatable insulating board adapted for use in electromagnetic induction devices such as electric transformer, reactor, etc., and more particularly to an oil-immersed insulating board having excellent heat resistance.

Needs for lightweight, compact-size and high flame retardant transformers has been on the rise in recent years, and in order to meet such needs, the insulating materials having high heat resistance have been sought for. Aromatic polyamides are acknowledged to be a material most suited for said purpose because of their high heat resistance and excellent electric properties, and the sheets made of such polyamide polymers are already available for certain uses.

These sheets are prepared by mixing short fibers made of an aromatic polyamide and fibrous particles closely analogous to wood pulp in configuration and by processing this mixture by a conventional paper making machine into sheets. Density of these sheets is as low as approximately 0.3 g/cm$^3$, and the available thickness is limited to less than 0.5 mm. Therefore, for using these sheets as an insulating material for transformers, it is necessary to pile up such sheets into the form of a board.

There are available two types of method of making the board: a method using an adhesive and a method letting the fibers fuse by applying high temperature and high pressure. According to the former method, the sheets are applied with a heat-resistant adhesive, laminated and bonded by curing the adhesive under heat and pressure. However, this method has the drawbacks that the heat-resistant properties of the laminated board obtained depend on the type of the adhesive used and that impregnation of the insulating oil into such board becomes non-uniform to create a situation liable to induce corona discharge. It has been proposed to coat or impregnate a solvent which can dissolve the aromatic polyamides. However, use of such solvent necessitates a measure for environmental protection against the poisonous activities of such solvent. Also, when such solvent is used, it is impossible to obtain a board with a uniform internal structure, and the strength and physical properties of the obtained board prove to be unsatisfactory.

On the other hand, in case of producing the board without using any adhesive, it is necessary to apply pressure in the order of 70 to 200 kg/cm$^2$ at an elevated temperature of from 280° to 300° C., which temperature range is close to the softening point of the aromatic polyamides. As a result, the produced board becomes very high in density and therefore poor in oil impregnatability.

The present invention has for its object to provide an oil-impregnatable insulating board in which insulating oil can impregnate uniformly, and of which strength properties are satisfactory. This object has been achieved as a result of extensive studies by the present inventors on this subject.

Thus, according to this invention, there is provided a method for producing an oil-impregnatable insulating board characterized in that an aqueous slurry prepared by mixing the fibrous particles of an aromatic polymer and short fibers made from said polymer and/or insulating inorganic short fibers is made into wet webs by a usual paper making process and, after adjusting the water content to 50 to 90% by weight, a desired number of these wet webs are laid up and then dewatered and dried for integration under heat and pressure.

The aromatic polymers used in this invention are aromatic polyamides and aromatic polyamide-imides which are highly heat-resistant.

The aromatic polyamides usable in this invention are those composed of the structure units shown by the following general formula (1), (2) or (3):

$$-NH-Ar_1-NH-CO-Ar_2-CO- \quad (1)$$

$$-NH-Ar_3-CO- \quad (2)$$

$$-NH-Ar_1-NH-CO-Ar_2-CO- \text{ and } -NH-Ar_3-CO- \quad (3)$$

wherein $Ar_1$, $Ar_2$ and $Ar_3$ represent independently a divalent aromatic group and may be the same or different from one another.

Typical examples of these aromatic polyamides include poly-(m-phenyleneisophthalamide), poly-(m-phenyleneterephthalamide), poly-(p-phenyleneterephthalamide), poly-(p-phenyleneisophthalamide), poly-(4,4'-oxydiphenyleneisophthalamide), poly-(4,4'-oxydiphenyleneterephthalamide), poly-(m-benzamide) and poly-(p-benzamide). It is possible to use the copolymers composed of the respective structural units of these homopolymers. Also, these homopolymers or copolymers may contain a small quantity of other components than the aromatic groups, such as piperazine, cyclohexanedicarboxylic acid and the like.

The aromatic polyamide-imides usable in this invention are those having the unit shown by the following general formula:

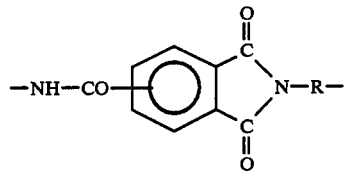

wherein R represents

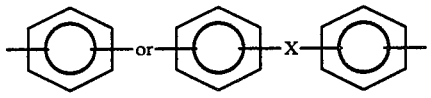

(where X is —O—, —$SO_2$—,

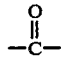

or a lower alkylene group).

Said aromatic polymers are used in this invention in the form of fibrous particles. By the term "fibrous particles" used here are meant the particles having a fibrous, filmy or ribbon-like structure with many branches and capable of making a web by using a paper machine. Such fibrous particles can be obtained by introducing a solution of an aromatic polymer of the said type into a precipitating medium to let said polymer precipitate in the form of fine particles. An example of preparation of such particles is shown in Japanese Patent Publication No. 5732/62, but the particles used in this invention is not limited to those obtained from this method; it is also possible to use other type of said polymer particles capable of forming a wet web.

The short fibers used in admixture with said fibrous particles in an aqueous slurry for making a wet web may be the fibers made from said type of aromatic polymer or inorganic short fibers or a mixture thereof. Preferred examples of said inorganic short fibers are glass fiber, ceramic fiber, alumina fiber, rock wool fiber and asbestos, or a mixture thereof. In view of the properties required for making the oil-impregnatable insulating board provided in this invention, these short fibers are naturally required to have the insulating characteristics, and hence the electroconductive fibers such as carbon fiber and metallic fiber must be excluded from the group of short fibers usable in this invention, in the case of the short fibers made of an aromatic polymer of said type, the fibrous structure of said polymer may be the same as or different from that of the fibrous particles. The short fibers may be the ones composed of an aromatic polymer alone or a mixture thereof with other inorganic fibers. They may be composed of inorganic fibers alone. The denier of the short fibers composed of said polymer is preferably within the range of 0.5 to 10 d, more preferably 1.5 to 3 d. In the case of the inorganic short fibers, the denier is within the range of 0.2 to 15$\mu$ in diameter. The short fiber length is 1 to 15 mm, preferably 3 to 8 mm.

When forming a mixture of said short fibers and fibrous particles for sheet making, the mixing ratio of the fibrous particles to the entire mixture should be within the range of 20 to 95 weight %, preferably 30 to 90 weight %. If the ratio of the fibrous particles is less than 20 weight %, the product proves to be poor in such properties as breakdown voltage and physical strength. On the other hand, the ratio of fibrous particles exceeds 95 weight %, it results in an excessively low impregnatability.

An aqueous slurry comprising a mixture of said short fibers and fibrous particles is formed into a wet web by a suitable paper machine such as fourdrienier machine, cylinder paper machine or inclined fourdrienier machine. If necessary, the water content of the web is adjusted to 50 to 95% by means of suctioning or pressing. If the water content of the web is less than 50%, adhesion between the layers is too weak to form a solid integrated board when the webs are laid up and dried. On the other hand, if the water content is higher than 95%, the web becomes vulnerable to deformation and hard to be laid up and the laminate cracks during the pressing and heating.

The thus obtained wet webs are laid up in a required number of layers necessary to attain the desired thickness of the board to be produced and then dewatered and dried under heat and pressure. Any temperature not exceeding the softening point of said polymer may be employed for heating of the web laminate, but the temperature range of 100° to 200° C. is preferred in the economical sense. The preferred range of pressure applied in the pressing is 10 to 60 kg/cm$^2$. As pressure increases, compression modulus of elasticity of the obtained board is improved while the oil-impregnatability decreases.

In this way, fast adhesion between the layers is achieved and a board of uniform and integrated structure having high physical strength, good electric properties and oil-impregnatability is obtained.

The invention is now described in further detail by way of some embodiments thereof, but this invention is of course not limited to these embodiments.

EXAMPLE 1

10 parts of polymethaphenylene isophthalamide having inherent viscosity of 1.5 in sulfuric acid was dissolved in 90 parts of N,N-dimethylacetamide containing 5 parts of LiCl, and this solution was introduced into an aqueous glycerin solution in a homomixer under high-speed agitation to obtain fibrous particles. The freeness of this fibrous particles was 80 ml (Canadian Standard Freeness). Separate from this, the polymethaphenylene isophthalamide was wet-spun, then drawn by 2.5 times in boiling water and crystallized at temperature of about 340° C. to obtain 2-denier fibers, and these fibers were cut to 6-mm length to prepare short fibers.

60 parts of said fibrous substance and 40 parts of said short fibers were dispersed in water and mixed to form a slurry, which was made into a wet web on a cylinder paper machine, and the thus formed wet web was transferred onto a felt and which was sucked to adjust the water content of the web to 90%. The solid basis weight of this wet web was 80 g/m$^2$. The thus obtained wet web was continuously laid up on a cylinder to form a 30-layer laminate, and this laminate was removed from the cylinder, placed between the iron plates on surface of which a wire cloth was laid to facilitate dewatering and dried at 140° C. under pressure of 40 kg/cm$^2$ for 40 minutes to obtain a 2.85 mm thick board.

EXAMPLE 2

60 parts of the same fibrous substance as used in Example 1 and 40 parts of glass fibers, having single filament diameter of 9$\mu$ and length of 6 mm, were mixed and processed by a cylinder paper machine to obtain a wet web, and after adjusting the water content to 85%, this wet web was laid up in 35 layers and the laminate was held between the iron plates with a wire cloth and dried at 140° C. under pressure of 40 kg/cm$^2$ for 35 minutes to obtain a 2.82 mm thick board.

COMPARATIVE EXAMPLE

The same slurry as referred to in Example 1 was molded and dried into a sheet having basis weight of 200 g/m$^2$. Then a heat-resistant epoxy resin was applied on one side of each sheet in a discontinuous geometrical pattern consisting of squares with 9 mm side length and then 12 of these sheets were laid up and the laminate was cured at 140° C. under 40 kg/cm$^2$ and made into a board.

The properties of the products from Examples 1 and 2 and Comparative Example are shown comparatively in Table 1.

TABLE 1

| | Example 1 | Example 2 | Comparative Example |
|---|---|---|---|
| Thickness (mm) | 2.85 | 2.82 | 2.68 |
| Density (g/cm$^2$) | 0.85 | 1.00 | 0.85 |
| Compression modulus of elasticity (kg/cm$^2$) | 2647 | 2820 | 1923 |
| Dielectric strength (KVrms/mm) | 36.2 | 36.2 | 33.8 |
| Partial discharge initiating electric field (KVrms/mm) | 18.6 | 18.0 | 12.5 |
| Oil-impregnatability | 40 | 44 | 22 |

TABLE 1-continued

| | Example 1 | Example 2 | Comparative Example |
|---|---|---|---|
| (mm/10 hr) | | | |
| Tensile strength (kg/mm$^2$) | | | |
| MD | 8.35 | 5.12 | 4.16 |
| CD | 4.73 | 2.90 | 2.82 |
| Weight loss (%) | | | |
| 180° C., 500 hr | 0.7 | 0.6 | 3.0 |
| 200° C., 500 hr | 1.6 | 1.3 | 5.6 |

Note 1. Dielectric strength: JIS electrode, AC.

Note 2. Partial discharge initiating electric field: the electric field required until the discharge (AC 60 Hz) of 20 Pc is reached with silicone oil impregnation.

Note 3. Oil impregnatability: the cross directional distance along which a silicone oil penetrates from the cut end of the board in 10 hours.

Example 3

10 parts of polyamide-imide (inherent viscosity in N-methyl-2-pyrrolidone: 0.5) obtained by reacting trimellitic acid anhydride and 4,4'-diaminodiphenylmethane in the molar ratio of 2:1 and, after dehydration, adding the trimellitic acid anhydride and 4,4'-diphenylmethane diisocyanate in the molar ratio of 2:3, was dissolved in 90 parts of N-methyl-2-pyrrolidone, and the mixed solution was introduced into an aqueous glycerin solution in a homomixer performing high-speed agitation to obtain fibrous particles. Separate from this 4 denier fibers obtained from similar polyamide-imide were cut to 8 mm length to prepare short fibers.

50 parts of said fibrous particles and 40 parts of said short fibers were dispersed in water to form a slurry and this slurry was processed by a cylinder paper machine to form a wet web, which was then transferred onto a felt and was sucked to adjust water content of the web to 80%. The basis weight of this wet web was 75 g/m$^2$. The thus obtained wet web was continuously wound up on a cylinder to form a 25-layer laminate and this laminate was dried under the same conditions as in Example 1. The product showed substantially the same properties as those of the products of the preceding examples.

EXAMPLE 4

50 parts of fibrous particles made of polyamideimide obtained in Example 3 and 50 parts of short fibers of 7 mm length obtained from the polymethaphenylene isophthalamide in Example 1 were dispersed in water to obtain a slurry and this slurry was treated by a cylinder paper machine to form a wet web, which was transferred onto a felt and sucked to adjust the water content of the web to 90%. The basis weight of this wet web was 70 g/m$^2$. The thus obtained wet web was continuously wound up on a cylinder to form a 30-layer laminate and this laminate was dried under the same conditions as in Example 1. The obtained product showed substantially the same properties as those of the products of the preceding examples.

What is claimed is:

1. A method of producing an oil-impregnatable insulating board characterized in that an aqueous slurry consisting of water and fibrous particles of a heat-resistant aromatic polymer and short fibers made from said polymer or insulating inorganic short fibers or a mixture thereof is subjected to a paper making process to form a wet web and, after adjusting the water content to 50 to 95% weight %, said wet web is laid up in a desired number of layers and then the laminate is dewatered and dried for integration under pressure of 10 to 60 kg/cm$^2$ at a temperature not exceeding the softening point of said aromatic polymer of between 100° to 200° C. the content of the fibrous particles in the mixture of the fibrous particles and inorganic short fibers or short fibers made from an aromatic polymer is 20 to 95% by weight.

2. The method of claim 1, wherein the aromatic polymer is aromatic polyamide.

3. The method of claim 1, wherein the aromatic polymer is aromatic polyamide-imide.

4. The method of claim 1, wherein the content of the fibrous particles is 30 to 90% by weight.

5. An oil-impregnatable insulating board produced according to the method of claim 1.

6. The method of claim 4 wherein the short fibers have a length of 1 to 15 mm.

7. The method of claim 6 wherein the short fibers have a length of 3 to 8 mm.

* * * * *